US010692354B2

(12) United States Patent
Thibodaux et al.

(10) Patent No.: US 10,692,354 B2
(45) Date of Patent: Jun. 23, 2020

(54) MEDICATION REMINDER

(71) Applicants: Patrick Thibodaux, Lafayette, LA (US); James E. Palmer, III, Lafayette, LA (US)

(72) Inventors: Patrick Thibodaux, Lafayette, LA (US); James E. Palmer, III, Lafayette, LA (US)

( * ) Notice: Subject to any disclaimer, the term of this patent is extended or adjusted under 35 U.S.C. 154(b) by 0 days.

(21) Appl. No.: 16/274,986

(22) Filed: Feb. 13, 2019

(65) Prior Publication Data

US 2020/0035083 A1 Jan. 30, 2020

Related U.S. Application Data

(60) Provisional application No. 62/702,968, filed on Jul. 25, 2018.

(51) Int. Cl.
*G08B 21/24* (2006.01)
*G08B 7/06* (2006.01)

(52) U.S. Cl.
CPC ..... *G08B 21/24* (2013.01); *G08B 7/06* (2013.01)

(58) Field of Classification Search
CPC .... A61J 2200/30; A61J 7/0481; A61J 7/0409; A61J 2200/70; A61J 7/0418; A61J 2200/74; A61J 2200/76; A61J 2205/70; A61J 7/0436; A61J 7/0472; A61J 2205/10; A61J 2205/60; A61J 7/0427; A61J 7/0445; A61J 7/04; A61J 7/049; G06F 19/3462; G06F 17/00; G06F 19/3456; G16H 20/13; G16H 10/60; G16H 10/65; G16H 40/63; F04C 2270/0421; G06Q 10/10; B65D 83/00; H04B 7/00; A61B 5/01; A61B 5/024; A61B 5/14551; A61B 5/4833; G08B 21/24; H04N 7/142; B42D 5/047; G04B 37/1406; G04B 47/00; G04G 13/00; G04G 15/006; G07F 13/025; G07F 17/0092
USPC ..... 340/309.7, 540, 309.16, 573.1, 286.11, 340/286.07, 309.8–309.9, 331–332, 340/815.45
See application file for complete search history.

(56) References Cited

U.S. PATENT DOCUMENTS

2005/0151625 A1* 7/2005 Lai ..... G08B 21/24 340/309.16
2010/0164716 A1* 7/2010 Estevez ..... G06F 19/3462 340/540
2011/0190928 A1* 8/2011 Jeyarajan ..... B65D 83/00 700/232

(Continued)

*Primary Examiner* — Daniel Previl
(74) *Attorney, Agent, or Firm* — IPR Law Group PC

(57) ABSTRACT

A device comprising a substrate including a processor, and the substrate is configured to couple to a container. A sensor is coupled to the processor and configured detect a change in a parameter of an environment including the container, and to generate a sensor signal in response to the detected change. An application running on the processor is configured to receive an input comprising a time interval corresponding to content of the container, track elapsed time of the time interval, and generate an alert signal upon detecting expiration of the time interval and the sensor signal. An indicator is coupled to the processor and configured to activate in response to receiving the alert signal. The activated indicator is configured as an alert to administer at least a portion of the content.

21 Claims, 4 Drawing Sheets

(56) References Cited

U.S. PATENT DOCUMENTS

| | | | | |
|---|---|---|---|---|
| 2013/0222135 | A1* | 8/2013 | Stein | A61J 7/0409 340/540 |
| 2014/0052468 | A1* | 2/2014 | Burrows | G06F 19/3456 705/2 |
| 2017/0046501 | A1* | 2/2017 | Coleman | A61J 7/0418 |
| 2017/0087059 | A1* | 3/2017 | Rodriguez | G16H 20/13 |

* cited by examiner

MEDICATION REMINDER

RELATED APPLICATION

This application claims the benefit of U.S. (US) Patent Application No. 62/702,968, filed Jul. 25, 2018.

TECHNICAL FIELD

Embodiments are generally directed to the dispensing of product for a user and, more particularly, the dispensing of medication for a patient using a reminder incorporated into or affixed to a container or package that includes the medicine.

BACKGROUND

Advances in medicine and medical science are enhancing the quality of life for many folks suffering from one or more ailments, many of which are now effectively managed with one or more drugs. In many cases, the patient only has to remember to take the medication over a prescribed interval (e.g., once daily, three times daily, etc.). However, a person may have difficulty remembering to take medication, with the result being that the amount of medication taken is insufficient to affect the course of the ailment. In a treatment regimen involving multiple drugs, such a scenario is even more convoluted and may pose grave consequences to the patient. Therefore, a need exists to help a patient follow his/her drug regimen as prescribed. This problem is even further worsened when the drug requires refrigerated storage as the patient may not see it as easily.

INCORPORATION BY REFERENCE

Each publication, patent, and/or patent application mentioned in this specification is herein incorporated by reference in its entirety to the same extent as if each individual publication, patent and/or patent application was specifically and individually indicated to be incorporated by reference.

DETAILED DESCRIPTION

The compliance with a drug regimen to treat a particular ailment is significant in achieving a successful outcome. Maintaining an efficacious level of the drug rests with taking a proper dose at the appropriate intervals. Embodiments include a medication reminder or alert system comprising an electronic system located on the medication container or package, and configured to generate and deliver or emit reminder alerts for taking a corresponding medication.

In an embodiment, a medication reminder is affixed to a container or package of medication so that it remains with the medication until the time when it is consumed by a patient. The medication reminder is configured to remind the user or patient to take a dose of the medication or other substance contained in the container or package. The medication reminder is a self-contained device comprising a processor coupled to one or more user-alert devices. The processor is programmed with a time interval that corresponds to the consumption interval associated with the medication dosage listed on the prescription, and the programming can be performed by a health professional (e.g., dispensary, pharmacist, physician, etc.) at the time the medication is provided to the patient, or can be done by another person or entity (e.g., drug manufacturer, device manufacturer, etc.) in advance of providing the medication to the health professional.

The processor is configured to track or countdown the time interval, and to generate an alert upon sensing an environmental condition following expiration of the time interval. Alternatively, the processor is configured to track or countdown the time interval, and to generate the alert based only on expiration of the time interval. The alert of an embodiment comprises one or more of a visual alert, an auditory alert, and a vibratory alert, but is not so limited. The environmental condition includes the sensing of light or movement in the environment in which the container is kept or stored, but is not so limited. The medication reminder of an embodiment further includes a user interface or input/output (I/O) device configured to receive touch-sensitive inputs by a user for alert acknowledgement. Other embodiments may include wireless connectivity such as Bluetooth, but is not so limited.

An alternative embodiment of the medication reminder is configured for use on multi-use containers or dispensers. The multi-use configuration of the medication reminder further includes a dose sensor to detect whether a dose of medication has been dispensed (e.g., a closure has been removed from the container, etc.) and generate a dispense signal in response. The processor is configured to use information of a dispense signal received from the dose sensor to reset the predetermined time interval.

Figure 1:
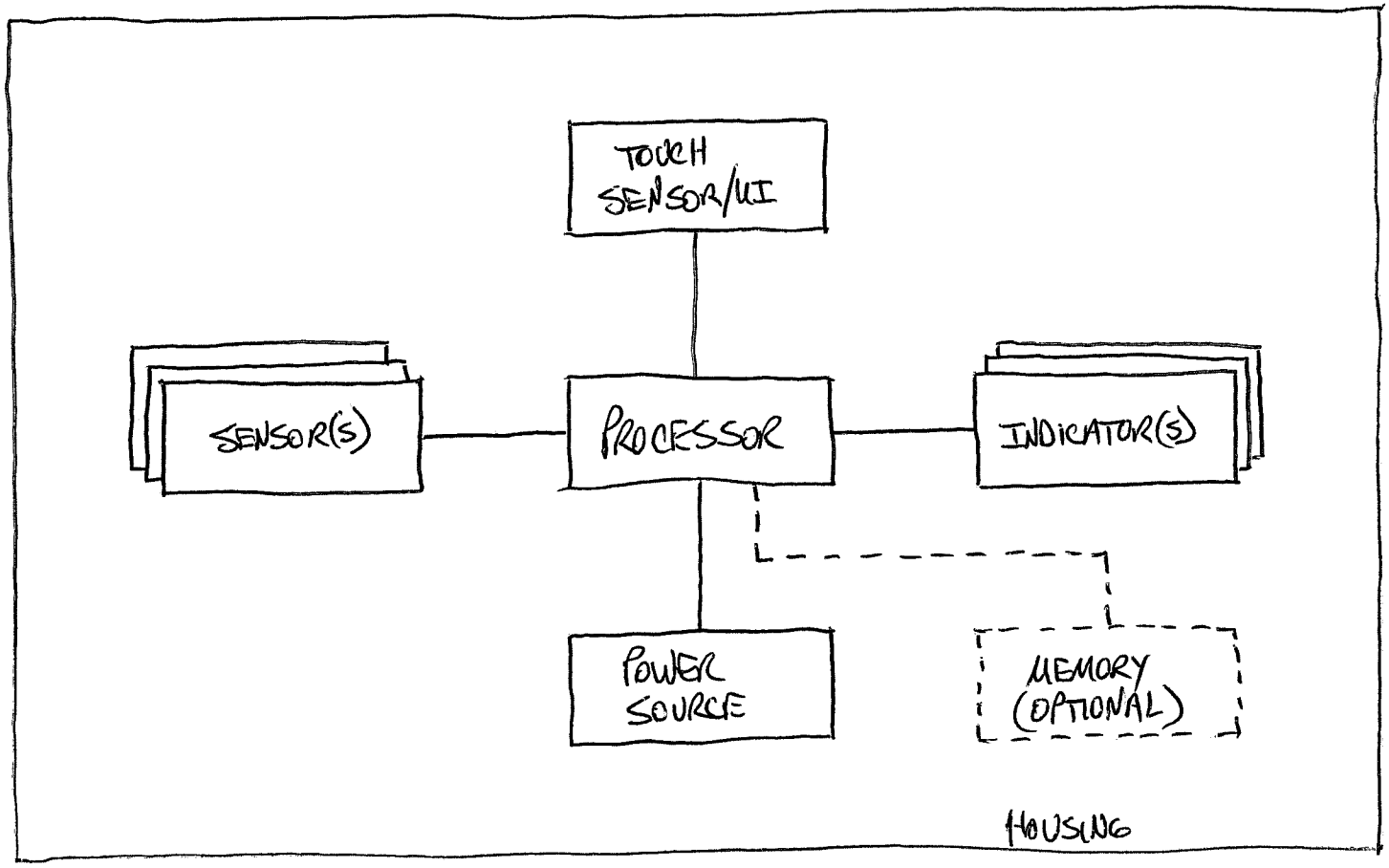
FIG. 1 is a block diagram of the medication reminder, under an embodiment.

FIG. 1 is a block diagram of the medication reminder, under an embodiment. The medication reminder includes a housing comprising a processor coupled to a power source and one or more indicators. The housing includes a circular form factor, but alternative embodiments can include any form factor (e.g., oval, rectangular, square, trapezoidal, etc.) appropriate to a configuration of the container or package of the medication. The processor is configured to include and execute a program that monitors the time interval or, more particularly, tracks elapsed time of the time interval in order to use information of the time interval to generate an alert to a patient at such time as the conditions indicate the patient is to administer the medication and is in the immediate vicinity of the medication. The processor is further configured to generate and send signals to one or more indicators used to alert the patient, as described in detail herein. The power source, which in an embodiment includes a battery, is configured to supply power to components of the medication reminder requiring power.

The indicators of an embodiment include one or more of a visual indicator, an auditory indicator, and a vibratory indicator, but are not so limited. The visual indicator includes one or more light-emitting indicators, for example light-emitting diode (LED) indicators, but is not so limited. The auditory indicator includes a sound-emitting device, for example a buzzer or alarm, to name a few. The vibratory indicator includes a vibrating device. While this example embodiment of the medication reminder includes one or more of three different types of indicators, alternative embodiments can include any number, type, and/or combination of these or alternative indicators.

The medication reminder further includes one or more sensors coupled to the processor. The sensor, which in an embodiment includes an environmental sensor, is configured to sense a change in at least one parameter or condition of the environment in which the medication or container is stored. In this example embodiment, the environmental sensor is a light sensor, and the light sensor is configured to generate a signal to the processor upon detecting light in the environment. However, alternative embodiments can include other or additional types of sensors as appropriate to the environment in which the medication is stored. Examples of other types of sensors used in the medication reminder can include one or more of an accelerometer, position sensor, proximity sensor, acoustic sensor, temperature sensor, and humidity sensor to name a few.

The medication reminder of an embodiment also includes a user interface coupled to the processor. The user interface is configured as a component of the container or package, for example. Alternatively, the user interface can be a component of a remote device that wirelessly couples to the processor (e.g., application running on a remote device). The user interface includes, for example, a touchscreen or other touch-sensitive interface configured for access by a user. The user interface is configured to generate a signal to the processor when touched by the user, and the processor is configured to silence the indicator(s) in response to the signal. The user interface of an alternative embodiment can include a graphical user interface configured to output to a user information corresponding to the corresponding medication, but is not so limited. The user interface of another alternative embodiment is configured to receive input data to program the time interval of the corresponding medication, but is not so limited.

The system of an embodiment is coupled to and/or includes a memory device. The memory device includes for example a memory device included as a component of the processor and/or a remote memory device coupled to the processor. The memory can be used to store any type of data related to the function of the device. By way of example, the memory could be used to store the number of times the user has acknowledged the alarm, and the time at which the user did the acknowledgement.

Figure 3:
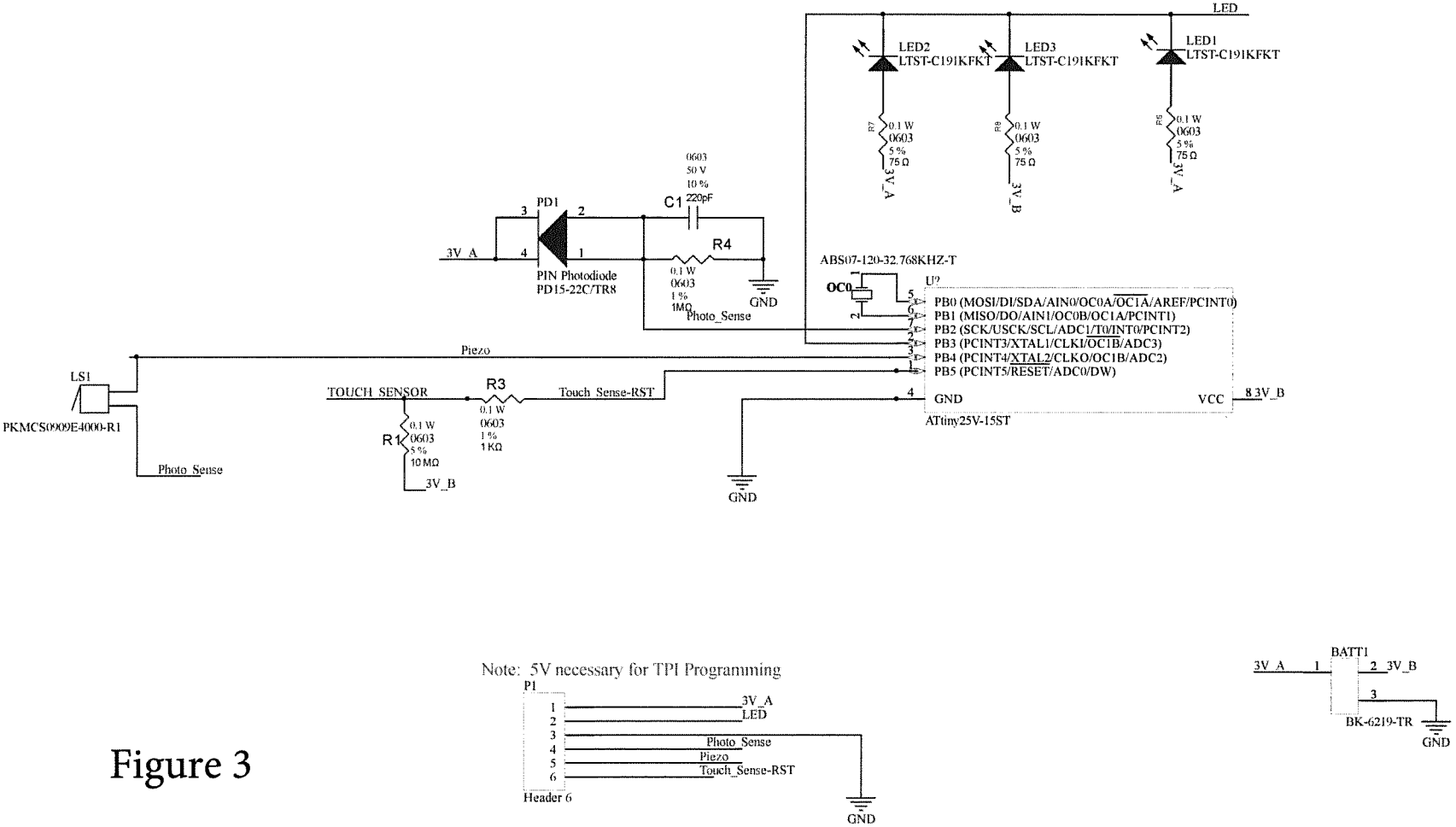
FIG. 3 is a schematic diagram of the medication reminder, under an embodiment.
Figure 4:
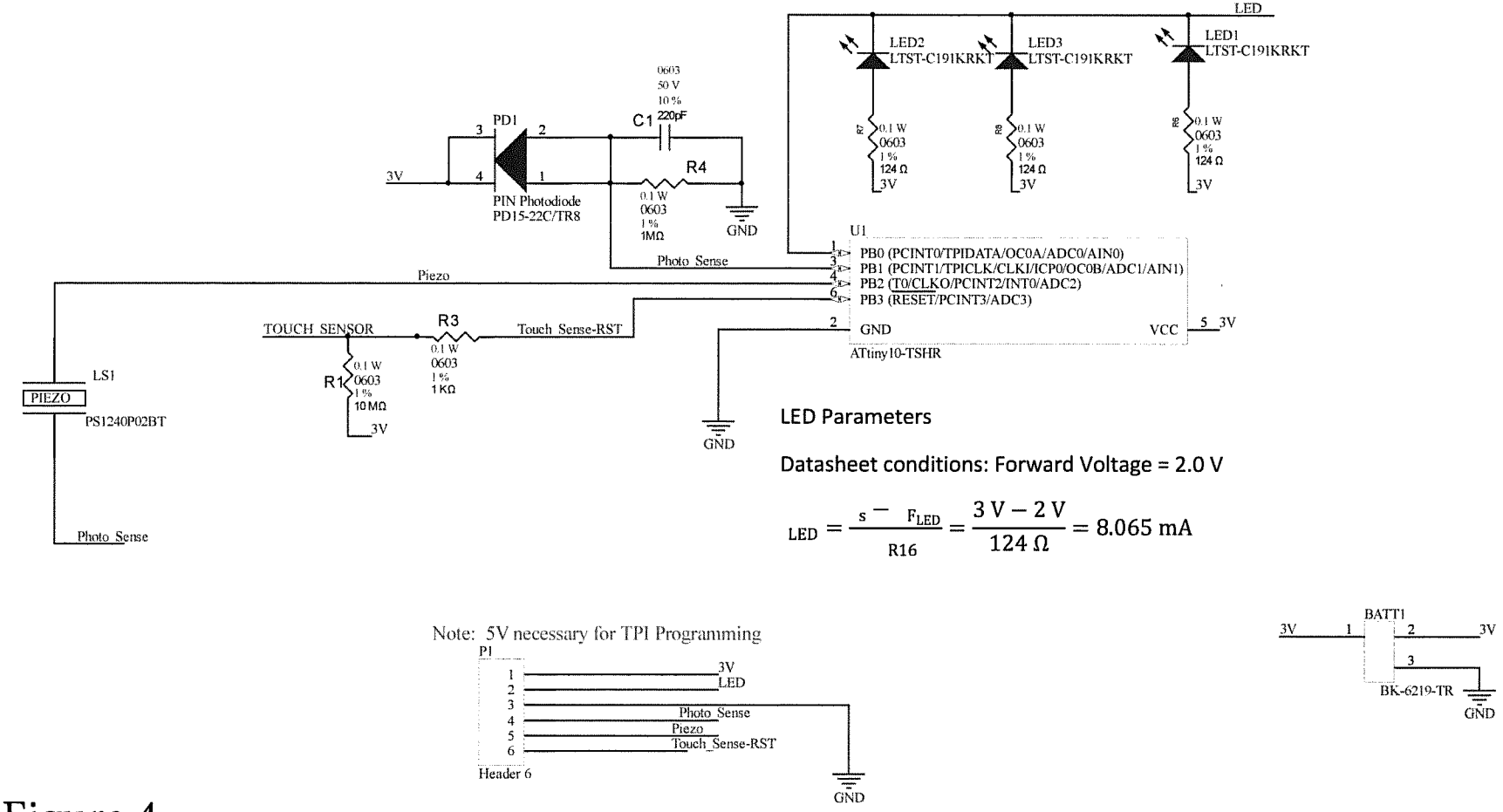
FIG. 4 is a schematic diagram of the medication reminder, under an alternative embodiment.

FIG. 3 is an example schematic diagram of the medication reminder, under an embodiment. FIG. 4 is another example schematic diagram of an implementation of the medication reminder, under an alternative embodiment. These exemplary schematic diagrams are included as examples only, and are not intended to limit the embodiments of the medication reminder described herein as it is capable of being implemented using any number of hardware, firmware and/or software configurations and/or combinations.

An operational example follows involving use of the medication reminder comprising both visual and auditory indicators. In this example, the medication to which the reminder is affixed is insulin, and the container includes the container in which the insulin is dispensed or provided to the patient (e.g., syringe, package containing syringe, etc.). As the medication in this example is insulin, it is required to be refrigerated until it is taken by the patient. While the example includes insulin as the medication, it is understood that the medication reminder can be used for any medication provided to a patient.

In operation, the medication reminder is a self-contained device configured to be coupled or attached (e.g., glue, tape, adhesive, etc.) to the container or package including the insulin. The container includes one or more of the container housing the medication and the package in which the container is sold or dispensed. The medication reminder of an embodiment is affixed to the container or package at the time the medication is dispensed by, for example, the dispensing health professional. In an alternative embodiment, the medication reminder is affixed to the container by the manufacturer or distributor of the corresponding medication.

Figure 2:
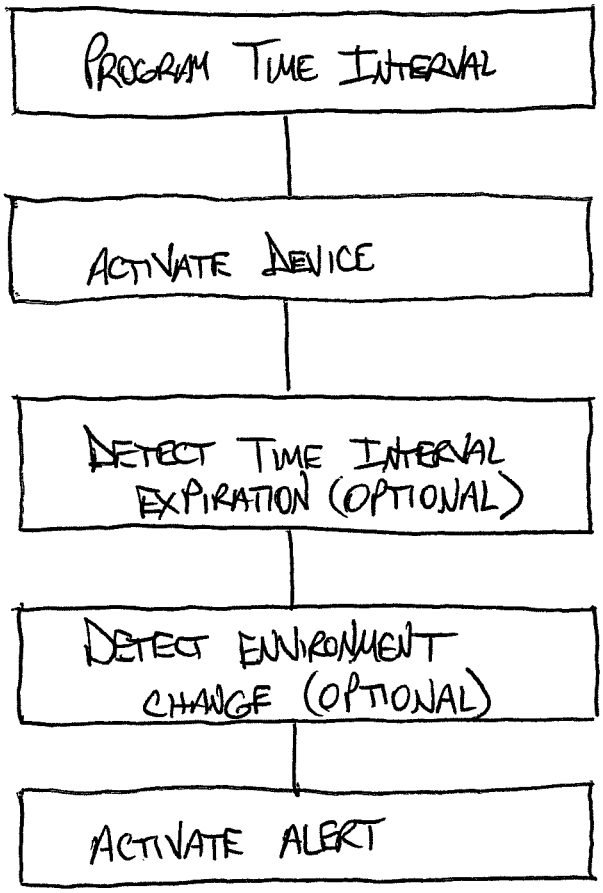
FIG. 2 is a flow diagram for generating a reminder or alert with the medication reminder, under an embodiment.

FIG. 2 is a flow diagram for the medication reminder, under an embodiment. Each medication reminder is pre-programmed with a particular time interval (e.g., 12 hours, 24 hours, etc.), and is marked (e.g., label, color, etc.) to indicate the programmed time interval. For example, a red colored medication reminder corresponds to a 12-hour dosage time interval, while a green colored medication reminder corresponds to a 24-hour time interval. In this example, assuming the medication reminder is affixed to the medication container by the dispensing healthcare professional, the healthcare professional selects the medication reminder having a color corresponding to the indicated time interval (e.g., pharmacist selects a green medication reminder for a 24-hour time interval), and affixes the selected medication reminder to the container.

In an alternative embodiment, the medication reminder is pre-programmed with multiple time intervals, one of which is selected and activated by the dispensing healthcare professional at the time the medication is dispensed via the user interface of the medication reminder. In another alternative embodiment, the medication reminder is programmed with a specific time interval by the dispensing healthcare professional at the time the medication is dispensed. The programming by the healthcare professional can be performed using the user interface of the medication reminder. Alternatively, the programming is performed by the healthcare professional using a portable electronic device (e.g., docking station, tablet computer, smart telephone, near-field communication device, etc.), and the medication container is configured to couple to portable electronic device via a wired, wireless, or hybrid wired and wireless coupling or connection.

In another alternative embodiment, the device includes a pre-programmed time interval, and is color-coded to indicate the pre-programmed time interval for correspondence with respective prescriptive periods, but is not so limited. Under this embodiment, the healthcare professional would select the correct color-coded device corresponding to the time interval of the associated medication, and would affix the selected device to the corresponding medication container, dispenser, or packaging.

Regardless of technique used for programming or loading the time interval into the medication reminder, the medication reminder is activated at the time the corresponding medication is dispensed, and the processor begins operating. For example, when the medication reminder is pre-programmed with the time interval, the dispensing healthcare professional activates the medication reminder (e.g., touching and/or holding the user interface, inputting data via the user interface, moving a switch to an "on" position, removing an insulator adjacent the medication reminder battery to cause the battery to activate the circuitry, etc.) immediately prior to providing the medication to the patient. In an alternative embodiment, the dispensing healthcare professional selects via the user interface a pre-programmed time interval from a number of pre-programmed time intervals, and activates the reminder. In another alternative embodiment, the dispensing healthcare professional programs via the user interface a time interval of the corresponding medication, and activates the reminder.

Once activated, the medication reminder processor tracks the remaining time of the time interval since activation in order to detect expiration of the time interval. Further, the processor is configured to detect a sensor signal from the sensor. In this example embodiment, the sensor includes a light sensor configured to detect the presence of light in the refrigerator in which the medication container is stored, and generate a sensor signal to the processor in response to the detected refrigerator light. The processor is configured to activate the visual and/or auditory indicators in response to detecting both the expired time interval time and receiving a signal from the light sensor, where the signal from the light signal is generated upon activation of the refrigerator light when the refrigerator is opened. In this manner, following expiration of the time interval, at the next instance of the patient opening the refrigerator in which the medication is stored, the processor detects activation of the refrigerator light and generates an alert signal configured to activate the indicators (e.g., visual and auditory) to alert the patient the he/she is due to take the medication.

In another alternative embodiment, the device does not include an environmental sensor and instead is configured to control or activate alarming based solely on expiration of the time interval. The device would alarm for a certain period of time (alarm period), say 1 minute for example (but could be any time). If the device is acknowledged by the user, the device would begin counting down the time interval. If the device is unacknowledged during the alarm period, the device is configured to enter into a "power saving alarm mode", otherwise called "chirp" mode. During chirp mode, the device is configured to initiate the countdown of the next time interval, while continuing to periodically emit brief alerts. The user can acknowledge the device during chirp mode, in which case the device is configured to cease emitting brief alerts until the next time interval expires, and the alarm mode is re-entered.

Unless the context clearly requires otherwise, throughout the description, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

The invention is preferably implemented using hardware, software or a combination of hardware and software. The software can also be embodied as computer readable code on a computer readable medium. The computer readable medium is any data storage device that can store data that can thereafter be read by a computer system. Examples of the computer readable medium include read-only memory, random-access memory, CD-ROMs, DVDs, magnetic tape, optical data storage devices, and carrier waves. The computer readable medium can also be distributed over network-coupled computer systems so that the computer readable code is stored and executed in a distributed fashion.

The description herein is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the claims.

While this invention has been described in terms of several preferred embodiments, there are alterations, permutations, and equivalents, which fall within the scope of this invention. It should also be noted that there are many alternative ways of implementing the methods and apparatuses of the present invention. Further, the various aspects, embodiments, implementations or features of the invention can be used separately or in any combination. It is therefore intended that the following appended claims be interpreted as including all such alterations, permutations, and equivalents as fall within the true spirit and scope of the present invention.

What is claimed is:

1. A device comprising:

a substrate including a processor, wherein the substrate is configured to be coupled to a container;

a sensor coupled to the processor and configured detect a change in a parameter of an environment including the container, and to generate a sensor signal in response to the detected change;

an application running on the processor, wherein the application is configured to receive an input comprising a time interval corresponding to content of the container, and track elapsed time of the time interval, wherein the application is configured to generate an alert signal upon detecting expiration of the time interval and the sensor signal; and an indicator coupled to the processor and configured to activate in response to receiving the alert signal, wherein the activated indicator is configured as an alert to administer at least a portion of the content.

2. The device of claim 1, wherein the application is configured to generate an alert signal upon detecting the sensor signal subsequent to expiration of the time interval.

3. The device of claim 1, wherein the indicator comprises a plurality of indicators.

4. The device of claim 3, wherein the plurality of indicators comprises a visual indicator and an auditory indicator.

5. The device of claim 1, wherein the indicator includes at least one of a visual indicator, an auditory indicator, and a vibratory indicator.

6. The device of claim 1, wherein the sensor includes a light sensor.

7. The device of claim 1, wherein the sensor comprises a plurality of sensors.

8. The device of claim 1, wherein the sensor includes at least one of a light sensor, position sensor, proximity sensor accelerometer, acoustic sensor, temperature sensor, and humidity sensor.

9. The device of claim 1, comprising a user interface (UI) coupled to the processor, wherein the UI is configured to receive the input.

10. The device of claim 9, wherein the UI is configured to output data corresponding to the content.

11. The device of claim 9, wherein the substrate includes the UI.

12. The device of claim 9, wherein the UI is presented at a remote device coupled to the processor.

13. The device of claim 9, wherein the time interval includes a plurality of time intervals, wherein the UI is configured to receive the input comprising selection of a time interval of the plurality of time intervals.

14. The device of claim 1, wherein the application is pre-programmed to include the time interval.

15. A method comprising:

detecting via a sensor a change in a parameter of an environment including a container, and generating a sensor signal in response to the detected change;

receiving an input comprising a time interval corresponding to content of the container, and tracking elapsed time of the time interval; and generating an alert signal upon detecting the sensor signal and expiration of the time interval, and activating an indicator at the container in response to the alert signal, wherein the activated indicator is an alert to administer at least a portion of content of the container.

16. The method of claim 15, wherein the application is configured to generate an alert signal upon detecting the sensor signal subsequent to expiration of the time interval.

17. The method of claim 15, wherein the parameter includes an increase in light level.

18. The method of claim 15, wherein receiving the input comprises receiving the input via a user interface (UI).

19. The method of claim 15, wherein receiving the input comprises pre-programming the application to include the time interval.

20. A method comprising:

configuring a substrate to include a processor and to couple to a container;

configuring a sensor to detect a change in a parameter of an environment including the container, and to generate a sensor signal in response to the detected change;

configuring an application to execute on the processor to receive an input comprising a time interval corresponding to content of the container, track elapsed time of the time interval, and generate an alert signal upon detecting expiration of the time interval and the sensor signal; and configuring an indicator to activate in response to the alert signal, wherein the activated indicator is configured as an alert to administer at least a portion of the content.

21. A device comprising:

a substrate including a processor, wherein the substrate is configured to be coupled to a container;

a sensor coupled to the processor and configured detect a change in a parameter of an environment including the container, and to generate a sensor signal in response to the detected change;

an application running on the processor, wherein the application is configured to receive an input comprising a time interval corresponding to content of the container, and track elapsed time of the time interval, wherein the application is configured to generate an alert signal upon detecting at least one of expiration of the time interval and the sensor signal; and an indicator coupled to the processor and configured to activate in response to receiving the alert signal, wherein the activated indicator is configured as an alert to administer at least a portion of the content.

* * * * *